US011107405B2

(12) United States Patent
Feng

(10) Patent No.: US 11,107,405 B2
(45) Date of Patent: Aug. 31, 2021

(54) PIXEL COMPENSATION CIRCUIT UNIT, PIXEL CIRCUIT AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventor: Yuhsiung Feng, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 445 days.

(21) Appl. No.: 16/305,426

(22) PCT Filed: Jun. 14, 2018

(86) PCT No.: PCT/CN2018/091292
§ 371 (c)(1),
(2) Date: Nov. 29, 2018

(87) PCT Pub. No.: WO2019/047584
PCT Pub. Date: Mar. 14, 2019

(65) Prior Publication Data

US 2021/0225285 A1 Jul. 22, 2021

(30) Foreign Application Priority Data

Sep. 8, 2017 (CN) ..... 201710805843.2

(51) Int. Cl.
*G09G 3/3258* (2016.01)

(52) U.S. Cl.
CPC ... *G09G 3/3258* (2013.01); *G09G 2300/0426* (2013.01); *G09G 2310/061* (2013.01)

(58) Field of Classification Search
None
See application file for complete search history.

(56) References Cited

U.S. PATENT DOCUMENTS

2009/0289876 A1 11/2009 Chun
2013/0038589 A1* 2/2013 Tseng ..... G09G 3/3233 345/211

(Continued)

FOREIGN PATENT DOCUMENTS

CN 103474025 A 12/2013
CN 103474026 A 12/2013

(Continued)

OTHER PUBLICATIONS

Office Action dated Jan. 22, 2020 issued in corresponding Chinese Application No. 201710805843.2.

(Continued)

*Primary Examiner* — Duane N Taylor, Jr.
(74) *Attorney, Agent, or Firm* — Nath, Goldberg & Meyer; Joshua B. Goldberg

(57) ABSTRACT

A pixel compensation circuit unit, a pixel circuit, and a display device are provided in the disclosure. The pixel compensation circuit unit may include a reset power supply line, a reset control circuit, a bridge circuit, and at least two pixel compensation circuits. The at least two pixel compensation circuits are coupled to the reset power supply line, respectively; the reset control circuit is coupled to the reset power supply line and the bridge circuit, respectively; and the at least two pixel compensation circuits are coupled by the bridge circuit. A plurality of pixel compensation circuits may share one reset power supply line, thereby reducing the number of reset power supply lines and simplifying the structure of the pixel compensation circuit unit.

20 Claims, 4 Drawing Sheets

(56) References Cited

U.S. PATENT DOCUMENTS

| | | | |
|---|---|---|---|
| 2015/0070252 | A1 | 3/2015 | Chen |
| 2015/0213761 | A1 | 7/2015 | Chen |
| 2016/0027379 | A1 | 1/2016 | Chen |
| 2018/0261160 | A1 | 9/2018 | Wu et al. |
| 2018/0342201 | A1 | 11/2018 | Feng |

FOREIGN PATENT DOCUMENTS

| | | | |
|---|---|---|---|
| CN | 103474027 | A | 12/2013 |
| CN | 104424880 | A | 3/2015 |
| CN | 106023898 | A | 10/2016 |
| CN | 106991966 | A | 7/2017 |

OTHER PUBLICATIONS

Extended European Search Report dated Mar. 16, 2021 corresponding to application No. 18804219.6-1209.

* cited by examiner

PIXEL COMPENSATION CIRCUIT UNIT, PIXEL CIRCUIT AND DISPLAY DEVICE

CROSS-REFERENCE TO RELATED APPLICATIONS

This is a National Phase Application filed under 35 U.S.C. 371 as a national stage of PCT/CN2018/091292, filed Jun. 14, 2018, an application claiming the benefit of Chinese Application No. 201710805843.2, filed Sep. 8, 2017, the content of each of which is hereby incorporated by reference in its entirety.

TECHNICAL FIELD

The present disclosure relates to the field of display technology, and in particular, to a pixel compensation circuit unit, a pixel circuit, and a display device.

BACKGROUND

An active-matrix organic light-emitting diode (AMOLED) display device is widely used due to its advantages such as a wider viewing angle, a higher refresh rate, and a thinner size compared with a conventional liquid crystal display.

At present, AMOLED display devices are provided with pixel compensation circuits, especially, the voltage compensation circuits that are widely used. Among the voltage compensation circuits, the data-direct compensation circuits are suitable for small-sized products, especially high-PPI products, because of its low requirements on the storage capacitor Cst.

SUMMARY

According to an aspect of the disclosure, a pixel compensation circuit unit is provided. The pixel compensation circuit unit may include a reset power supply line, a reset control circuit, a bridge circuit, and at least two pixel compensation circuits. The at least two pixel compensation circuits are coupled to the reset power supply line, respectively. One terminal of the reset control circuit is coupled to the reset power supply line, and the other terminal of the reset control circuit is coupled to the bridge circuit. The at least two pixel compensation circuits are coupled to each other by the bridge circuit.

In an embodiment, the at least two pixel compensation circuits may include a first pixel compensation circuit and a second pixel compensation circuit. The bridge circuit is coupled to a first node, and the first pixel compensation circuit is coupled to the first node. The bridge circuit is coupled to a second node, and the second pixel compensation circuit is coupled to the second node.

In an embodiment, the bridge circuit may include a first switch tube. A control electrode of the first switch tube is coupled to a first control power supply line, a first electrode of the first switch tube is coupled to the first node, and a second electrode of the first switch tube is coupled to the second node. The reset control circuit is couple to the first node.

In an embodiment, the bridge circuit may include a first switch tube. A control electrode of the first switch tube is coupled to a first control power supply line, a first electrode of the first switch tube is coupled to the first node, and a second electrode of the first switch tube is coupled to the second node. The reset control circuit is couple to the second node.

In an embodiment, the bridge circuit may include a second switch tube and a third switch tube. A control electrode of the second switch tube is couple to a first control power supply line, a first electrode of the second switch tube is coupled to the first node, and a second electrode of the second switch tube is coupled to a third node. A control electrode of the third switch tube is couple to the first control power supply line, a first electrode of the third switch tube is coupled to the third node, and a second electrode of the third switch tube is coupled to the second node. The reset control circuit is couple to the third node.

In an embodiment, the first switch tube is double-gate thin film transistor.

In an embodiment, the reset control circuit may include a fourth switch tube. A control electrode of the fourth switch tube is coupled to the first control power supply line, a first electrode of the fourth switch tube is coupled to the first node, and a second electrode of the fourth switch tube is coupled to the reset power supply line.

In an embodiment, the reset control circuit may include a fourth switch tube. A control electrode of the fourth switch tube is coupled to the first control power supply line, a first electrode of the fourth switch tube is coupled to the second node, and a second electrode of the fourth switch tube is coupled to the reset power supply line.

In an embodiment, the reset control circuit may include a fourth switch tube. A control electrode of the fourth switch tube is coupled to the first control power supply line, a first electrode of the fourth switch tube is coupled to the third node, and a second electrode of the fourth switch tube is coupled to the reset power supply line.

According to an aspect of the disclosure, a pixel circuit is provided, the pixel circuit may include a plurality of pixel compensation circuit units arranged in sequence. Each of the pixel compensation circuit units is the pixel compensation circuit unit described above.

According to an aspect of the disclosure, a display device is provided, the display device may include the pixel circuit described above.

DETAILED DESCRIPTION

In order to enable those skilled in the art to better understand the technical solutions of the present disclosure, a pixel compensation circuit unit, a pixel circuit and a display device according to the disclosure are described in detail below with reference to the accompanying drawings.

Figure 1:
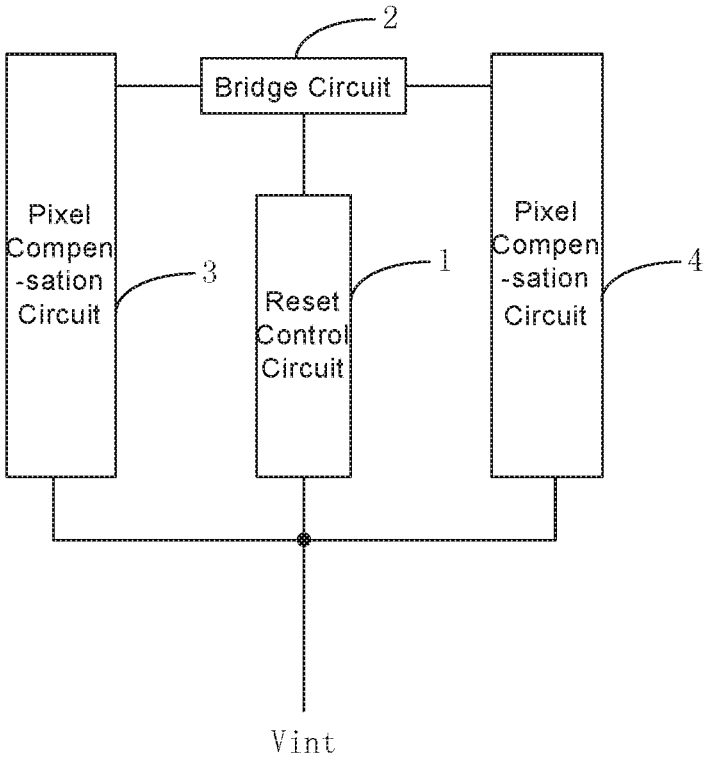
FIG. 1 is a schematic diagram of a structure of a pixel compensation circuit unit according to an embodiment of the present disclosure.

FIG. 1 is a schematic diagram of a structure of a pixel compensation circuit unit according to an embodiment of the present disclosure. As shown in FIG. 1, the pixel compensation circuit unit includes: a reset power supply line Vint, a reset control circuit 1, a bridge circuit 2, and at least two pixel compensation circuits. The at least two pixel compensation circuits are coupled to the reset power supply line Vint, respectively. One terminal of the reset control circuit 1 is coupled to the reset power supply line Vint, and the other terminal of the reset control circuit 1 is coupled to the bridge circuit 2. The at least two pixel compensation circuits are coupled by the bridge circuit 2.

Figure 2:
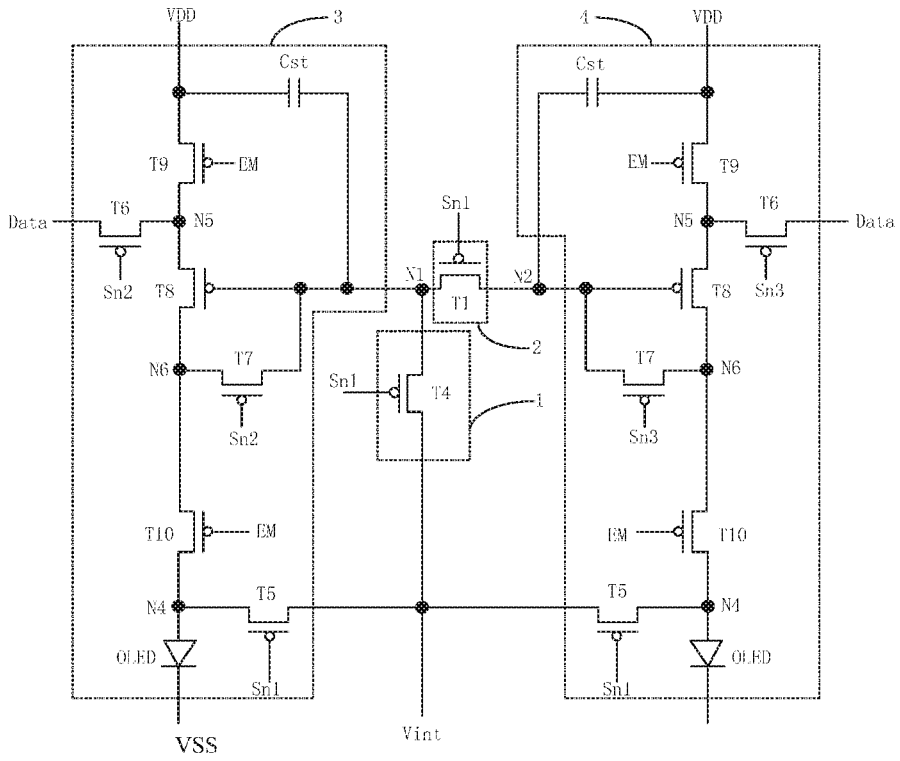
FIG. 2 is a detailed diagram of a structure of the pixel compensation circuit unit of FIG. 1.

In an embodiment, the at least two pixel compensation circuits may include two pixel compensation circuits, i.e., a first pixel compensation circuit 3 and a second pixel compensation circuit 4. That is, one of the at least two pixel compensation circuits is the first pixel compensation circuit 3, and the other one of the at least two pixel compensation circuits is the second pixel compensation circuit 4. As shown in FIG. 2, the bridge circuit 2 is coupled to a first node N1, the first pixel compensation circuit 3 is coupled to the first node N1, the bridge circuit 2 is coupled to a second node N2, and the second pixel compensation circuit 4 is coupled to the second node N2, thereby achieving connection between the first pixel compensation circuit 3 and the second pixel compensation circuit 4 through the bridge circuit 2. In the embodiment, the first pixel compensation circuit is a pixel compensation circuit in a previous row of pixel compensation circuits before the second pixel compensation circuit. For example, if the first pixel compensation circuit is in the previous row of pixel compensation circuits, the second pixel compensation circuit is in the current row of pixel compensation circuits. In the embodiment, the bridge circuit 2 can serve as a bridge connecting the first node N1 and the second node N2.

According to the pixel compensation circuit unit in the embodiment, the at least two pixel compensation circuits are coupled to the reset power supply line respectively, and the reset control circuit is coupled to the reset power supply line and the bridge circuit respectively, and the at least two pixel compensation circuits are coupled to each other by the bridge circuit. In the embodiment, a plurality of pixel compensation circuits share one reset power supply line, thereby reducing the number of reset power supply lines and simplifying the structure of the pixel compensation circuit unit.

FIG. 2 is a detailed diagram of a structure of the pixel compensation circuit unit of a. FIG. 1. As shown in FIG. 2, in the pixel compensation circuit unit in the embodiment, the bridge circuit 2 includes a first switch tube T1. A control electrode of the first switch tube T1 is coupled to a first control power supply line Sn1, a first electrode of the first switch tube T1 is coupled to a first node N1, and a second electrode of the first switch tube T1 is coupled to a second node N2. The reset control circuit 1 is coupled to the first node N1. In the embodiment, for example, the first switch tube T1 is a double-gate TFT, thereby effectively reducing a leakage current, and avoiding the problem that voltages at the first node N1 and the second node N2 are decreased significantly due to excessive leakage current, so that the voltages at the first node N1 and the second node N2 can be kept in predetermined levels during a frame.

In the embodiment, the reset control circuit 1 includes a fourth switch tube T4. A control electrode of the fourth switch tube T4 is coupled to the first control power supply line Sn1, a first electrode of the fourth switch tube T4 is coupled to the first node N1, and a second electrode of the fourth switch tube T4 is coupled to the reset power supply line Vint.

In the embodiment, the first pixel compensation circuit 3 includes a reset circuit, a charge control circuit, a driving circuit, a storage circuit, a switch circuit, and a light-emitting device.

The reset circuit includes a fifth switch tube T5. A control electrode of the fifth switch tube T5 is coupled to the first control power supply line Sn1, a first electrode of the fifth switch tube T5 is coupled to a fourth node N4, and a second electrode of the fifth switch tube T5 is coupled to the reset power supply line Vint.

The charge control circuit includes a sixth switch tube T6 and a seventh switch tube T7. A control electrode of the sixth switch tube T6 is coupled to a second control power supply line Sn2, a first electrode of the sixth switch tube T6 is coupled to a data line Data, and a second electrode of the sixth switch tube T6 is coupled to a fifth node N5. A control electrode of the seventh switch tube T7 is coupled to the second control power line Sn2, a first electrode of the seventh switch tube T7 is coupled to a sixth node N6, and a second electrode of the seventh switch tube T7 is coupled to the first node N1.

The driving circuit includes an eighth switch tube T8. A control electrode of the eighth switch tube T8 is coupled to the first node N1, a first electrode of the eighth switch tube T8 is coupled to the fifth node N5, and a second electrode of the eighth switch tube T8 is coupled to the sixth node N6.

The storage circuit includes a storage capacitor Cst. A first end of the storage capacitor Cst is coupled to a first voltage source, and the other end of the storage capacitor Cst is coupled to the first node N1. The first voltage source outputs a voltage VDD.

The switch circuit includes a ninth switch tube T9 and a tenth switch tube T10. A control electrode of the ninth switch tube T9 is coupled to a switch control power supply line EM, a first electrode of the ninth switch tube T9 is coupled to the first voltage source, and a second electrode of the ninth switch tube T9 is coupled to the fifth node N5. A control electrode of the tenth switch tube T10 is coupled to the switch control power supply line EM, a first electrode of the tenth switch tube T10 is coupled to the sixth node N6, and a second electrode of the tenth switch tube T10 is coupled to the fourth node N4.

A first end of the light-emitting device is coupled to the fourth node N4, and a second end of the light-emitting device is coupled to a second voltage source. For example, the light-emitting device includes an OLED, and a first end of the OLED is coupled to the fourth node N4, and the other end of the OLED is coupled to the second voltage source. The second voltage source outputs a voltage VSS.

In the embodiment, the second pixel compensation circuit 4 is a pixel compensation circuit in a row of pixel compensation circuits adjacent to the first pixel compensation circuit 3. The functional modules in the second pixel compensation circuit 4 are the same as those in the first pixel compensation circuit 3, but the connection between the functional modules in the second pixel compensation circuit 4 is different from that in the first pixel compensation circuit 3. Specifically, in the second pixel compensation circuit 4, a control electrode of the sixth switch tube T6 is coupled to a third control power supply line Sn3, a first electrode of the sixth switch tube T6 is coupled to the data line Data, and a second electrode of the sixth switch tube T6 is coupled to the fifth node N5. A control electrode of a seventh switch tube T7 is coupled to the third control power supply line Sn3, a first electrode of the seventh switch tube T7 is coupled to the sixth node N6, and a second electrode of the seventh switch tube T7 is coupled to the second node N2. For a description of the remaining structures in the second pixel compensation circuit 4, reference may be made to the first pixel compensation circuit 3, and the description thereof is omitted here.

In the embodiment, the third control power supply line Sn3 is coupled to the gate drive circuit (Gate Driver on Array, also called GOA for short) in current stage, and the gate drive circuit at current stage outputs a third control voltage, through the third control power supply line Sn3, to the sixth switch tube T6 and the seventh switch tube T7 in the second pixel compensation circuit 4. The GOA in immediately previous stage to the GOA in current stage is coupled to the second control power supply line Sn2, and the GOA in immediately previous stage outputs a second control voltage, through the second control power supply line Sn2, to the sixth switch tube T6 and the seventh switch tube T7 in the first pixel compensation circuit 3. A GOA in a stage, spaced apart from the GOA in current stage by one stage (i.e., the GOA immediately before the GOA in immediately previous stage), is coupled to the first control power supply line Sn1, and the GOA immediately before the GOA in immediately previous stage outputs a first control voltage, through the first control power supply line Sn1, to the first switch tube T1, the fourth switch tube T4, the fifth switch tube T5 in the first pixel compensation circuit 3, and a fifth switch tube T5 in the second pixel compensation circuit 4.

In the embodiment, each of the first to eleventh switch tubes T1 to T11 is a TFT transistor.

Figure 3:
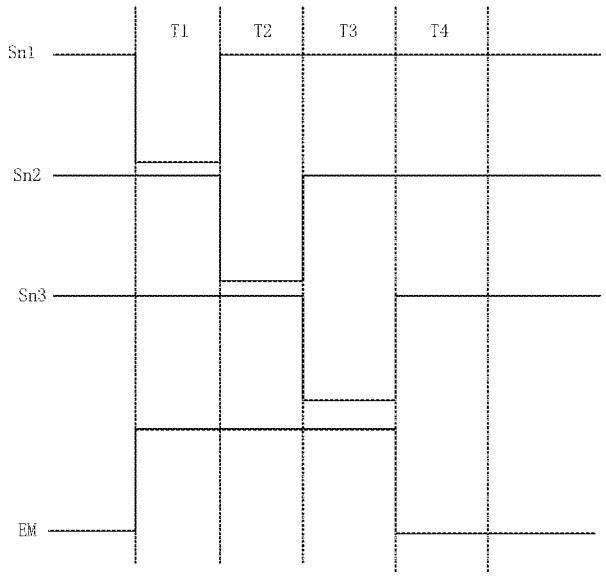
FIG. 3 is a timing diagram for driving the pixel compensation circuit unit of FIG. 1.

FIG. 3 is a timing diagram for driving the pixel compensation circuit unit of FIG. 1. The process for driving the pixel compensation circuit unit is described in details with reference to FIGS. 2 and 3.

In a reset phase T1, the first control voltage output through the first control power supply line Sn1 has a low level. The first control voltage is output to the control electrode of the first switch tube T1 through the first control power supply line Sn1, so that the first switch tube T1 is turned on; the first control voltage is output to the control electrode of the fourth switch tube T4 through the first control power supply line Sn1, so that the fourth switch tube T4 is turned on; the first control voltage is output, through the first control power supply line Sn1, to the control electrode of the fifth switch tube T5 in the first pixel compensation circuit 3 and the control electrode of the fifth switch tube T5 in the second pixel compensation circuit 4 respectively, so that the fifth switch tube T5 in the first pixel compensation circuit 3 and the fifth switch tube T5 in the second pixel compensation circuit 4 are turned on. A reset voltage is output to the first node N1 through the reset power supply line Vint and the turned-on fourth switch tube T4, so as to reset the first node N1. The reset voltage is output to the second node N2 through the reset power supply line Vint and the turned-on fourth switch tube T4 and the turned-on first switch tube T1, so as to reset the second node N2. The reset voltage is output to the fourth node N4 in the first pixel compensation circuit 3 through the reset power supply line Vint and the turned-on fifth switch tube T5 in the first pixel compensation circuit 3, so as to reset the fourth node N4 in the first pixel compensation circuit 3. The reset voltage is output to the fourth node N4 in the second pixel compensation circuit 4 through the reset power supply line Vint and the turned-on fifth switch tube T5 in the second pixel compensation circuit 4, so as to reset the fourth node N4 in the second pixel compensation circuit 4. Since the reset voltage has a low level, each of the first node N1, the second N2, the fourth node N4 in the first pixel compensation circuit 3, and the fourth node N4 in the second pixel compensation circuit 4 has a low lever after reset process.

In a first charging phase T2, the second control voltage output through the second control power supply line Sn2 has a low level. The second control voltage is output to the sixth switch tube T6 in the first pixel compensation circuit 3 though the second control power supply line Sn2, so that the sixth switch tube T6 in the first pixel compensation circuit 3 is turned on. The second control voltage is output to the seventh switch tube T7 in the first pixel compensation circuit 3 though the second control power supply line Sn2, so that the seventh switch tube T7 in the first pixel compensation circuit 3 is turned on. Since the seventh switch tube T7 is turned on, the eighth switch tube T8 serves as a diode. The first node N1 is charged with an output voltage from the data line Data through the turned-on sixth switch tube T6 and the eighth switch tube T8 in the first pixel compensation circuit 3, and energy is stored in the storage capacitor Cst, so that the first node N1 has a voltage of Vdata+Vth, wherein Vdata is the output voltage of the data line Data, and Vth is a threshold voltage of the eighth switch tube T8. In the embodiment, the changing process of the first pixel compensation circuit 3 is realized in the first charging phase T2.

In a second charging phase T3, the third control voltage output through the third control power supply line Sn3 has a low level. The third control voltage is output to the sixth switch tube T6 in the second pixel compensation circuit 4 though the third control power supply line Sn3, so that the sixth switch tube T6 in the second pixel compensation circuit 4 is turned on. The third control voltage is output to the seventh switch tube T7 in the second pixel compensation circuit 4 though the third control power supply line Sn3, so that the seventh switch tube T7 in the second pixel compensation circuit 4 is turned on. Since the seventh switch tube T7 is turned on, the eighth switch tube T8 serves as a diode. The second node N2 is charged with an output voltage from the data line Data through the turned-on sixth switch tube T6 and the eighth switch tube T8 in the second pixel compensation circuit 4, and energy is stored in the storage capacitor Cst, so that the second node N2 has a voltage of Vdata+Vth, wherein Vdata is the output voltage of the data line Data, and Vth is the threshold voltage of the eighth switch tube T8. In the embodiment, the changing process of the second pixel compensation circuit 4 is realized in the second charging phase T3.

In a light-emitting phase T4, a switch control voltage output by the switch control power supply line EM has a low level. The switch control voltage is output to each of the ninth switch T9 and the tenth switch T10 in the first pixel compensation circuit 3 through the switch control power supply line EM, so that each of the ninth switch T9 and the tenth switch T10 in the first pixel compensation circuit 3 is turned on. The switch control voltage is output to each of the ninth switch T9 and the tenth switch T10 in the second pixel compensation circuit 4 through the switch control power supply line EM, so that each of the ninth switch T9 and the tenth switch T10 in the second pixel compensation circuit 4 is turned on. In the first pixel compensation 3 or the second pixel compensation 4, the eighth switch tube T8 may convert voltage stored in the storage capacitor Cst into a driving current for driving OLED. The driving current is defined as: $I=\frac{1}{2}*\mu_p*C_{ox}*W/L*(Vgs-Vth)$, wherein $\mu_p$ is the hole mobility, $C_{ox}$ is a permittivity of an insulation layer, W/L is a rate of width to length. since $Vgs=Vdata+Vth-VDD$, $I=\frac{1}{2}*\mu_p*C_{ox}*W/L*(Vdata+Vth-VDD-Vth)=\frac{1}{2}*\mu_p*C_{ox}*W/L*(Vdata-VDD)$. As can be seen from the above formula, the driving current is independent of Vth, which improves display uniformity of pixels. In the light-emitting phase T4, the OLEDs in the first pixel compensation circuit 3 and the second pixel compensation circuit 4 may emit light simultaneously. In the embodiment, the first voltage source may output a voltage VDD having a high level, and the second voltage source may output a voltage VSS having a low level.

It should be noted that, in the reset phase T1, the first charging phase T2 and the second charging phase T3, since the switch control voltage output through the switch control power supply line EM has a high level, the ninth switch tube T9 and the tenth switch tube T10 in the first pixel compensation circuit 3 are turned off, and the ninth switch tube T9 and the tenth switch tube T10 in the second pixel compensation circuit 4 are turned off.

According to the pixel compensation circuit unit in the embodiment, at least two pixel compensation circuits are coupled to the reset power supply line respectively, and the reset control circuit is coupled to the reset power supply line and the bridge circuit respectively, and at least two pixel compensation circuits are coupled to each other by the bridge circuit. In the embodiment, a plurality of pixel compensation circuits may share one reset power supply line, thereby reducing the number of reset power supply lines and simplifying the structure of the pixel compensation circuit unit. In the embodiment, the switch control voltage output through the switch control power supply line is shared by the first pixel compensation circuit and the second pixel compensation circuit, so that signal input is simplified in the design of circuit layout. In the embodiment, the voltage output through the first control power supply line Sn1 is used as the first control voltage for the first pixel compensation circuit and the second pixel compensation circuit to reset the first pixel compensation circuit and the second pixel compensation circuit, so that the GOA outputs only one control voltage to the two pixel compensation circuits, thereby reducing the number of stages of the GOAs.

Figure 4:
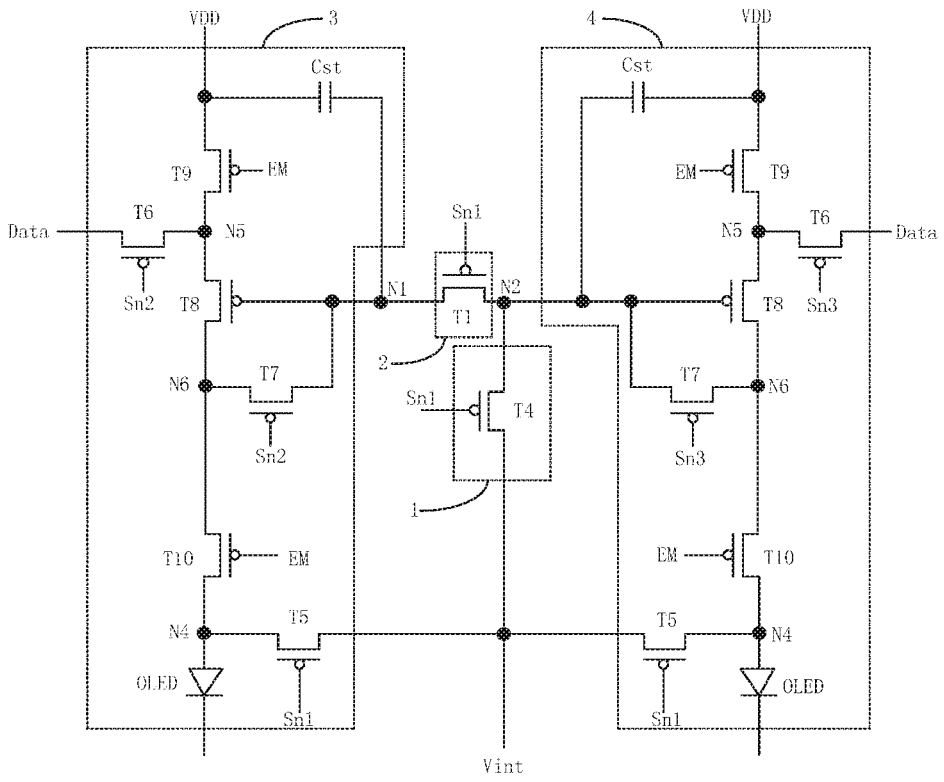
FIG. 4 is a detailed diagram of a structure of a pixel compensation circuit unit according to another embodiment of the present disclosure.

FIG. 4 is a detailed diagram of a structure of a pixel compensation circuit unit according to another embodiment of the present disclosure. As shown in FIG. 4, the pixel compensation circuit unit in FIG. 4 is different from the pixel compensation circuit unit in above embodiments in that the bridge circuit 2 includes a first switch tube T1. A control electrode of the first switch tube T1 is coupled to the first control power supply line Sn1, a first electrode of the first switch tube T1 is coupled to the first node N1, and a second electrode of the first switch tube T2 is coupled to the second node N2. The reset control circuit 1 is coupled to the second node N2. In the embodiment, for example, the first switch tube T1 is a double-gate TFT, thereby effectively reducing a leakage current, and avoiding the problem that voltages at the first node N1 and the second node N2 are decreased significantly due to excessive leakage current, so that the voltages at the first node N1 and the second node N2 can be kept in predetermined levels during a frame.

The reset control circuit 1 includes a fourth switch tube T4. A control electrode of the fourth switch tube T4 is coupled to the first control power supply line Sn1, a first electrode of the fourth switch tube T4 is coupled to the second node N2, and a second electrode of the fourth switch tube T4 is coupled to the reset power supply line Vint.

In a reset phase T1, the first control voltage output through the first control power supply line Sn1 has a low level. The first control voltage is output to the control electrode of the first switch tube T1 through the first control power supply line Sn1, so that the first switch tube T1 is turned on; the first control voltage is output to the control electrode of the fourth switch tube T4 through the first control power supply line Sn1, so that the fourth switch tube T4 is turned on; the first control voltage is output, through the first control power supply line Sn1, to the control electrode of the fifth switch tube T5 in the first pixel compensation circuit 3 and the control electrode of the fifth switch tube T5 in the second pixel compensation circuit 4 respectively, so that the fifth switch tube T5 in the first pixel compensation circuit 3 and the fifth switch tube T5 in the second pixel compensation circuit 4 are turned on. A reset voltage is output to the second node N2 through the reset power supply line Vint and the turned-on fourth switch tube T4, so as to reset the second node N2. The reset voltage is output to the first node N1 through the reset power supply line Vint and the turned-on fourth switch tube T4 and the turned-on first switch tube T1, so as to reset the first node N1. The reset voltage is output to the fourth node N4 in the first pixel compensation circuit 3 through the reset power supply line Vint and the turned-on fifth switch tube T5 in the first pixel compensation circuit 3, so as to reset the fourth node N4 in the first pixel compensation circuit 3. The reset voltage is output to the fourth node N4 in the second pixel compensation circuit 4 through the reset power supply line Vint and the turned-on fifth switch tube T5 in the second pixel compensation circuit 4, so as to reset the fourth node N4 in the second pixel compensation circuit 4. Since the reset voltage has a low level, each of the first node N1, the second N2, the fourth node N4 in the first pixel compensation circuit 3, and the fourth node N4 in the second pixel compensation circuit 4 has a low lever after reset process.

The descriptions of other circuits and the operation phases thereof are the same as those shown in FIG. 2. For details, reference can be made to the embodiment of FIG. 2, and the description thereof is not repeated herein.

According to the pixel compensation circuit unit in the embodiment, at least two pixel compensation circuits are coupled to the reset power supply line respectively, and the reset control circuit is coupled to the reset power supply line and the bridge circuit respectively, and at least two pixel compensation circuits are coupled to each other by the bridge circuit. In the embodiment, a plurality of pixel compensation circuits may share one reset power supply line, thereby reducing the number of reset power supply lines and simplifying the structure of the pixel compensation circuit unit. In the embodiment, the switch control voltage output through the switch control power supply line is shared by the first pixel compensation circuit and the second pixel compensation circuit, so that signal input is simplified in the design of circuit layout.

Figure 5:
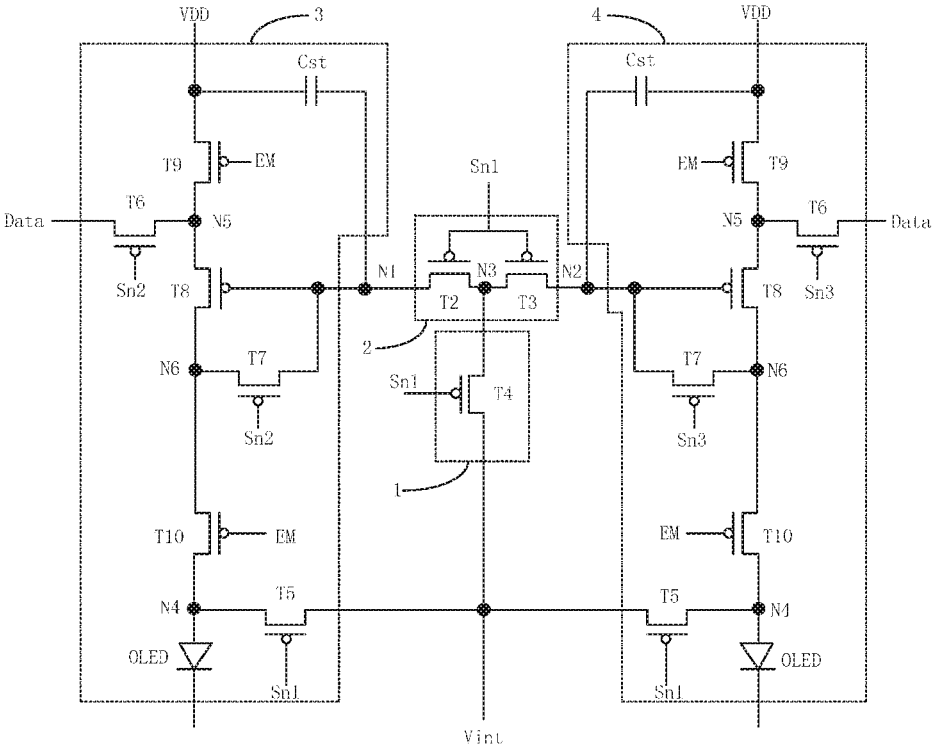
FIG. 5 is a schematic diagram of a structure of a pixel compensation circuit unit according to still another embodiment of the present disclosure.

FIG. 5 is a schematic diagram of a structure of a pixel compensation circuit unit according to still another embodiment of the present disclosure. As shown in FIG. 5, the pixel compensation circuit unit in FIG. 5 is different from the pixel compensation circuit unit in any of the above embodiments in that the bridge circuit 2 includes a second switch tube T2 and a third switch tube T3. A control electrode of the second switch tube T2 is couple to a first control power supply line Sn1, a first electrode of the first switch tube T2 is coupled to the first node N1, and a second electrode of the second switch tube T2 is coupled to a third node N3; a control electrode of the third switch tube T3 is couple to the first control power supply line Sn1, a first electrode of the third switch tube T3 is coupled to the third node N3, and a second electrode of the third switch tube T3 is coupled to the second node N2. The reset control circuit 1 is coupled to the third node N3. In the embodiment, for example, each of the second switch tube T1 and the third switch tube T3 is a single-gate TFT, and two single-gate TFT serve as one double-gate TFT, thereby effectively reducing a leakage current, and avoiding the problem that voltages at the first node N1 and the second node N2 are decreased significantly due to excessive leakage current, so that the voltages at the first node N1 and the second node N2 can be kept in predetermined levels during a frame. In addition, since the two single-gate TFTs are symmetrically arranged in the pixel compensation circuit unit, and there is no difference in leakage current in the two single-gate TFTs, thereby causing the capacitors on both sides to be maintained at the same level, so that gray scales are displayed to be the same when the two pixel compensation circuits in the pixel compensation circuit unit operate.

The reset control circuit 1 includes a fourth switch tube T4. A control electrode of the fourth switch tube T4 is coupled to the first control power supply line Sn1, a first electrode of the fourth switch tube T4 is coupled to the third node N3, and a second electrode of the fourth switch tube 14 is coupled to the reset power supply line Vint.

In a reset phase T1, the first control voltage output through the first control power supply line Sn1 has a low level. The first control voltage is output to the control electrode of the second switch tube T2 through the first control power supply line Sn1, so that the second switch tube T2 is turned on; the first control voltage is output to the control electrode of the third switch tube T3 through the first control power supply line Sn1, so that the third switch tube T3 is turned on; the first control voltage is output to the control electrode of the fourth switch tube T4 through the first control power supply line Sn1, so that the fourth switch tube T4 is turned on; the first control voltage is output, through the first control power supply line Sn1, to the control electrode of the fifth switch tube T5 in the first pixel compensation circuit 3 and the control electrode of the fifth switch tube T5 in the second pixel compensation circuit 4 respectively, so that the fifth switch tube T5 in the first pixel compensation circuit 3 and the fifth switch tube T5 in the second pixel compensation circuit 4 are turned on. A reset voltage is output to the first node N1 through the reset power supply line Vint and the turned-on fourth switch tube T4 and the turned-on second switch tube T2, so as to reset the first node N1. The reset voltage is output to the second node N2 through the reset power supply line Vint and the turned-on fourth switch tube T4 and the turned-on third switch tube T3, so as to reset the second node N2. The reset voltage is output to the fourth node N4 in the first pixel compensation circuit 3 through the reset power supply line Vint and the turned-on fifth switch tube T5 in the first pixel compensation circuit 3, so as to reset the fourth node N4 in the first pixel compensation circuit 3. The reset voltage is output to the fourth node N4 in the second pixel compensation circuit 4 through the reset power supply line Vint and the turned-on fifth switch tube T5 in the second pixel compensation circuit 4, so as to reset the fourth node N4 in the second pixel compensation circuit 4. Since the reset voltage has a low level, each of the first node N1, the second N2, the fourth node N4 in the first pixel compensation circuit 3, and the fourth node N4 in the second pixel compensation circuit 4 has a low lever after reset process.

The descriptions of other circuits and the operation phases thereof are the same as those shown in FIG. 2. For details, reference can be made to the embodiment of FIG. 2, and the description thereof is not repeated herein.

According to the pixel compensation circuit unit in the embodiment, at least two pixel compensation circuits are coupled to the reset power supply line respectively, and the reset control circuit is coupled to the reset power supply line and the bridge circuit respectively, and at least two pixel compensation circuits are coupled to each other by the bridge circuit. In the embodiment, a plurality of pixel compensation circuits may share one reset power supply line, thereby reducing the number of reset power supply lines and simplifying the structure of the pixel compensation circuit unit. In the embodiment, the switch control voltage output through the switch control power supply line is shared by the first pixel compensation circuit and the second pixel compensation circuit, so that signal input is simplified in the design of circuit layout.

A pixel circuit is provided in an embodiment of the disclosure, and the pixel circuit may include a plurality of pixel compensation circuit units arranged sequentially. Each of the plurality of pixel compensation circuit units may include the pixel compensation circuit unit according to anyone of the embodiments described above.

According to the pixel circuit in the embodiment, at least two pixel compensation circuits are coupled to the reset power supply line respectively, and the reset control circuit is coupled to the reset power supply line and the bridge circuit respectively, and at least two pixel compensation circuits are coupled to each other by the bridge circuit. In the embodiment, a plurality of pixel compensation circuits may share one reset power supply line, thereby reducing the number of reset power supply lines and simplifying the structure of the pixel compensation circuit unit. In the embodiment, the switch control voltage output through the switch control power supply line is shared by the first pixel compensation circuit and the second pixel compensation circuit, so that signal input is simplified in the design of circuit layout.

A display device is provided in an embodiment of the disclosure, and the display device may include the pixel circuit above.

According to the display device in the embodiment, at least two pixel compensation circuits are coupled to the reset power supply line respectively, and the reset control circuit is coupled to the reset power supply line and the bridge circuit respectively, and at least two pixel compensation circuits are coupled to each other by the bridge circuit. In the embodiment, a plurality of pixel compensation circuits may share one reset power supply line, thereby reducing the number of reset power supply lines and simplifying the structure of the pixel compensation circuit unit. In the embodiment, the switch control voltage output through the switch control power supply line is shared by the first pixel compensation circuit and the second pixel compensation circuit, so that signal input is simplified in the design of circuit layout.

It should be understood that the above implementations are merely exemplary embodiments for the purpose of illustrating the principles of the disclosure, however, the present disclosure is not limited thereto. It will be apparent to those skilled in the art that various changes and modifications can be made without departing from the spirit and spirit of the present disclosure, which are also to be regarded within the scope of the present disclosure.

What is claimed is:

1. A pixel compensation circuit unit comprising: a reset power supply line, a reset control circuit, a bridge circuit, and at least two pixel compensation circuits, wherein the at least two pixel compensation circuits are coupled to the reset power supply line, respectively;

a first terminal of the reset control circuit is coupled to the reset power supply line, and a second terminal of the reset control circuit is coupled to the bridge circuit; and the at least two pixel compensation circuits are coupled to each other by the bridge circuit.

2. The pixel compensation circuit unit according to claim 1, wherein the at least two pixel compensation circuits comprise a first pixel compensation circuit and a second pixel compensation circuit;

the bridge circuit is coupled to a first node, and the first pixel compensation circuit is coupled to the first node; and the bridge circuit is coupled to a second node, and the second pixel compensation circuit is coupled to the second node.

3. The pixel compensation circuit unit according to claim 2, wherein the bridge circuit comprises a first switch;

a control electrode of the first switch is coupled to a first control power supply line, a first electrode of the first switch is coupled to the first node, and a second electrode of the first switch is coupled to the second node; and the reset control circuit is couple to the first node.

4. The pixel compensation circuit unit according to claim 2, wherein the bridge circuit comprises a first switch;

a control electrode of the first switch is coupled to a first control power supply line, a first electrode of the first switch is coupled to the first node, and a second electrode of the first switch is coupled to the second node; and the reset control circuit is couple to the second node.

5. The pixel compensation circuit unit according to claim 2, wherein the bridge circuit comprises a second switch and a third switch;

a control electrode of the second switch is couple to a first control power supply line, a first electrode of the second switch is coupled to the first node, and a second electrode of the second switch is coupled to a third node;

a control electrode of the third switch is couple to the first control power supply line, a first electrode of the third switch is coupled to the third node, and a second electrode of the third switch is coupled to the second node; and the reset control circuit is couple to the third node.

6. The pixel compensation circuit unit according to claim 3, wherein the first switch is double-gate thin film transistor.

7. The pixel compensation circuit unit according to claim 3, wherein the reset control circuit comprises a fourth switch; and a control electrode of the fourth switch is coupled to the first control power supply line, a first electrode of the fourth switch is coupled to the first node, and a second electrode of the fourth switch is coupled to the reset power supply line.

8. The pixel compensation circuit unit according to claim 4, wherein the reset control circuit comprises a fourth switch; and a control electrode of the fourth switch is coupled to the first control power supply line, a first electrode of the fourth switch is coupled to the second node, and a second electrode of the fourth switch is coupled to the reset power supply line.

9. The pixel compensation circuit unit according to claim 5, wherein the reset control circuit comprises a fourth switch; and a control electrode of the fourth switch is coupled to the first control power supply line, a first electrode of the fourth switch is coupled to the third node, and a second electrode of the fourth switch is coupled to the reset power supply line.

10. A pixel circuit comprising a plurality of pixel compensation circuit units arranged in sequence, wherein each of the pixel compensation circuit units is the pixel compensation circuit unit of claim 1.

11. A display device comprising a pixel circuit, wherein the pixel circuit is the pixel circuit of claim 10.

12. A pixel circuit comprising a plurality of pixel compensation circuit units arranged in sequence, wherein each of the pixel compensation circuit units is the pixel compensation circuit unit of claim 2.

13. A pixel circuit comprising a plurality of pixel compensation circuit units arranged in sequence, wherein each of the pixel compensation circuit units is the pixel compensation circuit unit of claim 3.

14. A pixel circuit comprising a plurality of pixel compensation circuit units arranged in sequence, wherein each of the pixel compensation circuit units is the pixel compensation circuit unit of claim 4.

15. A pixel circuit comprising a plurality of pixel compensation circuit units arranged in sequence, wherein each of the pixel compensation circuit units is the pixel compensation circuit unit of claim 5.

16. A display device comprising a pixel circuit, wherein the pixel circuit is the pixel circuit of claim 12.

17. A display device comprising a pixel circuit, wherein the pixel circuit is the pixel circuit of claim 13.

18. A display device comprising a pixel circuit, wherein the pixel circuit is the pixel circuit of claim 14.

19. A display device comprising a pixel circuit, wherein the pixel circuit is the pixel circuit of claim 15.

20. The pixel compensation circuit unit according to claim 4, wherein the first switch is double-gate thin film transistor.

* * * * *